US011502450B2

(12) United States Patent
Chu et al.

(10) Patent No.: US 11,502,450 B2
(45) Date of Patent: Nov. 15, 2022

(54) SYSTEMS FOR DYNAMICALLY ADJUSTABLE GROUNDING CONNECTIONS

(71) Applicant: Dell Products L.P., Hopkinton, MA (US)

(72) Inventors: Yi-Pai Chu, Taoyuan (TW); Chih-Wen Huang, Taoyuan (TW)

(73) Assignee: Dell Products L.P., Round Rock, TX (US)

( * ) Notice: Subject to any disclaimer, the term of this patent is extended or adjusted under 35 U.S.C. 154(b) by 144 days.

(21) Appl. No.: 17/067,615

(22) Filed: Oct. 9, 2020

(65) Prior Publication Data

US 2022/0115809 A1 Apr. 14, 2022

(51) Int. Cl.
*H01R 11/30* (2006.01)
*H01R 13/62* (2006.01)
*H01R 13/652* (2006.01)

(52) U.S. Cl.
CPC ..... *H01R 13/6205* (2013.01); *H01R 13/652* (2013.01)

(58) Field of Classification Search
CPC .. H01R 11/30; H01R 13/6205; H01R 13/648; H01R 13/6485; H01R 13/652
See application file for complete search history.

(56) References Cited

U.S. PATENT DOCUMENTS 3,363,214 A * 1/1968 Wright ..... H01R 13/6205 439/39
5,325,248 A * 6/1994 Tabuchi ..... G11B 5/53 360/281.6
5,921,783 A * 7/1999 Fritsch ..... H01R 13/703 439/700
6,808,405 B1 * 10/2004 Uratani ..... H01R 13/7037 439/39
6,943,287 B2 9/2005 Lloyd et al.
7,967,609 B2 * 6/2011 Capece ..... H01R 13/7037 439/39
8,105,091 B2 * 1/2012 Nishihira ..... H01R 24/38 439/39
8,465,834 B2 6/2013 Kim
9,004,924 B2 * 4/2015 Kuo ..... H01R 13/6205 439/39
9,300,081 B2 * 3/2016 Rudisill ..... H01R 11/30
9,941,627 B2 * 4/2018 Esmaeili ..... H01R 13/5213
10,069,265 B2 * 9/2018 Wu ..... H02J 7/00
10,938,147 B2 * 3/2021 Esmaeili ..... H01R 13/22

* cited by examiner

*Primary Examiner* — Thanh Tam T Le
(74) *Attorney, Agent, or Firm* — Chamberlain, Hrdlicka, White, Williams & Aughtry

(57) ABSTRACT

A grounding contact configured to electrically couple a first chassis wall to a second chassis wall, that includes a standoff a magnet, and a contact element, where the standoff is rigidly coupled to the first chassis wall, where the contact element is directly contacting the second chassis wall, and where the contact element is disposed between the magnet and the second chassis wall.

10 Claims, 7 Drawing Sheets

SYSTEMS FOR DYNAMICALLY ADJUSTABLE GROUNDING CONNECTIONS

BACKGROUND

Devices and/or components of devices are often capable of performing certain functionalities that other devices and/or components are not configured to perform and/or are not capable of performing. In such scenarios, it may be desirable to adapt one or more systems to enhance the functionalities of devices and/or components that cannot perform the one or more functionalities.

SUMMARY

In general, in one aspect, embodiments relate to a grounding contact configured to electrically couple a first chassis wall to a second chassis wall, that includes a standoff, a magnet, and a contact element.

In general, in one aspect, embodiments relate to a method for electrically coupling a first chassis wall and a second chassis wall, that includes moving the second chassis wall towards the first chassis wall, in response to moving the second chassis wall, causing a contact element to contact the second chassis wall, and in response to the contact element contacting the second chassis wall, electrically coupling the first chassis wall and the second chassis wall.

In general, in one aspect, embodiments relate to a chassis, that includes a first chassis wall, a second chassis wall, and a grounding contact, that includes a standoff, a magnet, and a contact element.

Other aspects of the invention will be apparent from the following description and the appended claims.

DETAILED DESCRIPTION

Figure 1:
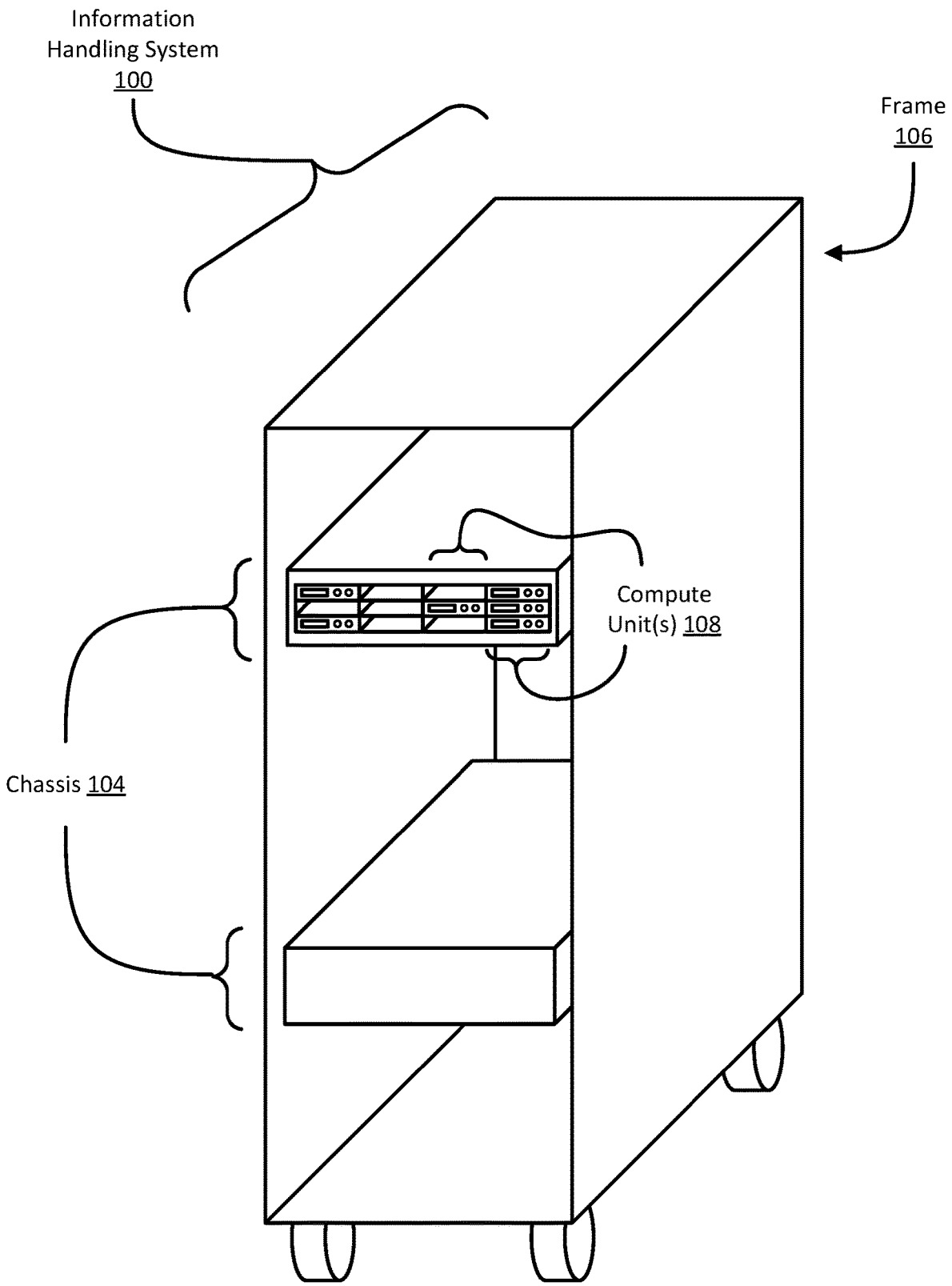
FIG. 1 shows a diagram of information handling system, in accordance with one or more embodiments of the invention.

In general, embodiments of the invention relate to systems and methods for providing durable and dynamic systems for maintaining electrically conductive contact between surface elements of an electrical device. In one or more embodiments of the invention, the body and/or external surfaces of an electrical device ideally maintain a voltage equivalent to the "ground" voltage of the power source supplying electrical power to the electrical device. To accomplish this, a power supply of the electrical device may electrically couple the body of the electrical device to the "ground" contact of the supplied power line. However, the electrically conductive coupling may occur in only one or a few places on the electrical device body.

Thus, a problem arises when surfaces of the electrical device are (i) less electrically coupled to the "grounded" surface (e.g., through minimally contacting joints or hinges), or (ii) located at a sufficiently far distance from the point of electrically conductive coupling to "ground". Specifically, distance surfaces, or surfaces that are poorly electrically coupled to ground, may act as an antenna that accrues ambient voltage from the surrounding environment. Consequently, such voltage difference (between the surface antenna and ground) can cause interference with one or more electrical components of the electrical device (causing a loss in efficiency, functionality, or damage).

To solve this problem, additional conductive contacts are inserted between surfaces of the electrical device that may have insufficient electrically conductive coupling. For example, an electrical device may be constructed of multiple flat sheet metal 'walls' that are assembled to form the outer structure of the device. Further, one or more of these surfaces may be easily removable to allow for easy access to components on the interior of the electrical device. Such a removable surface structure may have poor electrically conductive contact with the surrounding (and better grounded) surfaces. Accordingly, adhesive conductive strips may be placed along the overlapping surfaces of the removable surface of the electrical device and the surfaces in which the removable surface makes contact. Accordingly, the adhesive and electrically conductive strips ensure much greater electrically conductive coupling between the two surfaces forcing any accrued voltage (on the removable surface) to dissipate through the body of the electrical device and into the ground connection of the power supply.

Yet, another problem arises with the use of adhesive conductive strips. For example, if the removable surface (that makes contact with the adhesive conductive strips) is frequently removed and replaced, the adhesive conductive strips may peel away from their surface and thus stop providing conductive coupling between surfaces (e.g., through "wear and tear"). Further, due to the adhesion materials used, the electrical device surface (where the adhesive strips are applied) may change color, causing an unsightly and unappealing appearance. To solve these additional problems, as described in one or more embodiments of the invention disclosed herein, dynamically adjusting grounding contacts may be used in place of adhesive conductive strips to provide electrically conductive coupling between two surfaces. And, because the grounding contacts are not affixed via adhesion, the grounding contacts cannot lose adhesiveness. And, for that same reason, grounding contacts are also not prone to coloration changes—as no adhesion material is used. Lastly, due to their dynamically adjustable feature, the grounding contacts may be used in more structures where the gap distance between surfaces may vary.

Specific embodiments will now be described with reference to the accompanying figures. In the following description, numerous details are set forth as examples of the invention. One of ordinary skill in the art, having the benefit of this detailed description, would appreciate that one or more embodiments of the present invention may be practiced without these specific details and that numerous variations or modifications may be possible without departing from the scope of the invention. Certain details known to those of ordinary skill in the art may be omitted to avoid obscuring the description.

In the following description of the figures, any component described with regard to a figure, in various embodiments of the invention, may be equivalent to one or more like-named components shown and/or described with regard to any other figure. For brevity, descriptions of these components may not be repeated with regard to each figure. Thus, each and every embodiment of the components of each figure is incorporated by reference and assumed to be optionally present within every other figure having one or more like-named components. Additionally, in accordance with various embodiments of the invention, any description of any component of a figure is to be interpreted as an optional embodiment, which may be implemented in addition to, in conjunction with, or in place of the embodiments described with regard to a corresponding like-named component in any other figure.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

As used herein, the term 'operatively connected', or 'operative connection', means that there exists between elements/components/devices a direct or indirect connection that allows the elements to interact with one another in some way (e.g., via the exchange of information). For example, the phrase 'operatively connected' may refer to any direct (e.g., wired connection or wireless connection directly between two devices) or indirect (e.g., wired and/or wireless connections between any number of devices connecting the operatively connected devices) connection.

FIG. 1 shows a diagram of information handling system, in accordance with one or more embodiments of the invention. The information handling system (100) may include a frame (e.g., frame (106)) and one or more chassis (e.g., chassis (104)). The components of the example information handling system (100) may include mounting capabilities to mount one or more chassis (104). By doing so, devices may be stacked in a high-density computing environment.

In one or more embodiments of the invention, the information handling system (100) is a physical structure. The information handling system (100) may include a frame (e.g., frame (106)) that may be adapted to facilitate storage of one or more chassis (104) in a high-density computing environment. The high-density computing environment may be, for example, a data center or another type of location where one or more chassis (104) are located.

The frame (106) may be constructed using any number of suitable materials. For example, portions of the frame (106) may be implemented using metals (e.g., steel, aluminum, etc.). In another example, portions of the frame (106) may be implemented using polymers (e.g., polyamides, polycarbonates, polyester, polyethylene, polypropylene, polystyrene, polyurethanes, polyvinyl chloride, etc.). As another example, portions of the frame (106) may be implemented using rubber (e.g., latex, styrene-butadiene rubbers, etc.). One of ordinary skill in the art, having the benefit of this detailed description, would appreciate that the frame (106) may be implemented using any quantity and combination of suitable materials without departing from the scope of this invention.

To facilitate mounting of one or more chassis (104), the frame (106) may include any number of structural members (e.g., beams, brackets, bars, etc.) and any number of mechanical mounting points (e.g., holes, threaded portions, etc.) disposed on the structural members to facilitate storage of one or more chassis (104). Different structural members may have different shapes, sizes, and/or other physical characteristics. The shapes, sizes, and/or other physical characteristics of the structural members may be adapted to enable the structural members to be mechanically connected (e.g., permanently, or reversibly, connected) to each other to form a predetermined structure. The predetermined structure may be, for example, a cage, box, or other type of structure that facilitates positioning and/or orienting one or more chassis (104).

When all, or a portion, of the structural members are mechanically connected to each other, the mechanical mounting points may be disposed at predetermined locations. The predetermined locations may correspond to similar predetermined locations on a chassis (104) where mechanical mounting elements, complementary to the mechanical mounting points, are disposed. By doing so, the frame (106) may be adapted to position a chassis (104) in locations and/or orientations suitable for a high-density computing environment, or another environment in which a chassis (104) may be located. The mechanical mounting points may be any type of physical structure for mechanically coupling (permanently or reversibly) a chassis (104) to the frame (106). There may be any number of mechanical mounting points to facilitate the mechanical coupling of any number of corresponding chassis (104).

To facilitate mechanical coupling of a chassis (104) to the frame, the chassis (104) may include any number of mechanical mounting elements. The mechanical mounting elements may be located at predetermined locations. For example, a mechanical mounting element may be a rail disposed on a side of a chassis (104). The location of the rail may correspond to a position on the frame (106) where a rail guide (i.e., a complementary mechanical mounting point) is disposed. The rail and the rail guide may facilitate mechanical coupling of a chassis (104) to the frame (106) which, in turn, positions and orients a chassis (104) relative to the frame (106) and information handling system (100), generally.

In one or more embodiments of the invention, a chassis (e.g., chassis (104)) is a physical device that houses one or more components (e.g., compute unit(s) (108)) in one or more bay(s) or houses other computing components in a suitable internal volume. In one embodiment of the invention, a chassis (104) may have different configurations and/or uses within the information handling system (100). In one or more embodiments of the invention, an information handling system (100) may include any number and combination of chassis (104) adapted for any number of different uses and/or sizes without departing from the scope of the invention. By way of example, chassis (104) may execute a server for hosting a website, or alternatively, chassis (104) may host a media server, which stores media files. Further, one chassis (104) may be of a larger physical size than another chassis (104) and, consequently, may be capable of housing more and/or larger compute units (e.g., compute unit(s) (108)) therein. Additional detail regarding the description of a chassis (104) and a compute unit(s) (108) is provided in the description of FIGS. 2-3.

While the specific information handling system (100) of FIG. 1 has been illustrated as including a limited number of components, an information handling system (100) in accordance with embodiments of the invention may include any number of frames, chassis, compute units, and/or other components without departing from the invention. For example, any number of frames (and/or other types of physical devices for positioning/orienting devices) may be used in a high density computing environment to facilitate the placement and/or orientation of any number of chassis and/or compute units. Further, the frames may be used to position and/or orient other types of devices. The other types of devices may be, for example, servers, storage nodes, compute nodes, communication devices (e.g., switches, routers, etc. for facilitating communications between any number of devices and/or devices external to a high density computing environment), or any other type of device that may be used in a computing environment (e.g., data center, computing nodes, communications center, etc.). Thus, the frame may be used in conjunction with any number and/or type of other device without departing from the invention.

Figure 2:
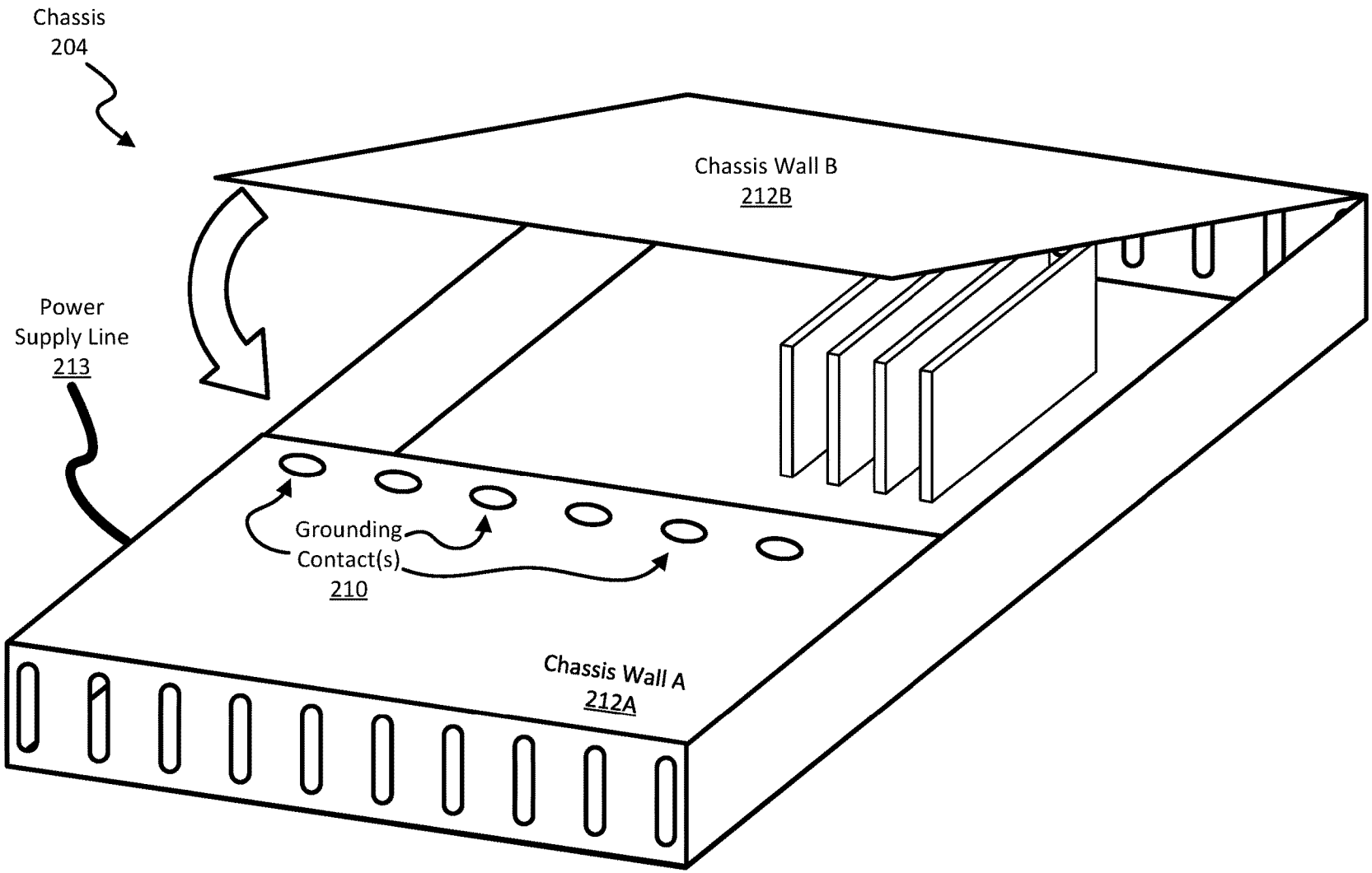
FIG. 2 shows a diagram of a chassis, in accordance with one or more embodiments of the invention.

FIG. 2 shows a diagram of a chassis, in accordance with one or more embodiments of the invention. In one or more embodiments of the invention, a chassis (e.g., chassis (204)) is an electrical and/or mechanical device that is adapted to (i) house one or more compute unit(s) (not shown), (ii) provide electrical operative connection(s) (e.g., peripherals) to one or more compute unit(s) (not shown) (e.g., for electrical power and/or communications), and/or (iii) provide shared resources to one or more compute unit(s) (not shown). A chassis (e.g., chassis (204)) may include one or more chassis wall(s) (e.g., chassis wall A (212A), chassis wall B (212B)), one or more grounding contact(s) (e.g., grounding contact(s) (210)), and may be connected to a power supply line (e.g., power supply line (213)). Each of these components is described below.

In one or more embodiments of the invention, a power supply line (e.g., power supply line (213)) includes two or more electrically conductive contacts that are capable of providing electrical power to the chassis (204). The power supply line (213) may include a "hot" contact with a voltage relatively higher than a second "ground" and third "neutral" contact (if present). One of ordinary skill in the art, having the benefit of this detailed description, would appreciate the ordinary construction and functioning of electrical power supply and power supply line.

As shown in FIG. 2, in one or more embodiments of the invention, the chassis (204) may include a chassis wall (chassis wall B (212B)) that is configured to be removed (and/or able to be rotated away) from the body of the chassis (204). Chassis wall B (212B) may be constructed such that the rear portion of chassis wall B (212B) is rotatably connected to the chassis (e.g., via a hinge). Alternatively, chassis wall B (212B) may be entirely removable from the chassis (204) and reinstalled such that the rear side of chassis wall B (212B) must be inserted prior to lowering the front side (near chassis wall A (212A)) into position. Further, when the front portion of chassis wall B (212B) is lowered into position, chassis wall B (212B) will overlap a portion of chassis wall A (212A) covering each of the six grounding contacts (210) shown in FIG. 2.

In one or more embodiments of the invention, a ground contact (e.g., grounding contact(s) (210)) are electrically conductive components that provide an electrically conductive bridge between tow surfaces thereby forcing those two surfaces to dissipate any voltage difference across a grounding contact (210) and into an attached ground. Accordingly, due to the grounding contacts (210), the electrically conductive coupling between chassis wall A (212A) and chassis wall B (212B) will be sufficient enough that ambient voltages gathered by chassis wall B (212B) will be transferred to chassis wall A (212A) and then carried into the ground contact of power supply line (213). Accordingly, due to the placement of the grounding contacts (210) between chassis wall A (212A) and chassis wall B (212B), chassis wall B (212B) is more electrically coupled to the grounded chassis wall A (212A) than if no additional conductive coupling were provided in the overlapped areas.

While FIG. 2 shows a specific configuration of a chassis, other configurations may be used without departing from the scope of the invention. For example, although FIG. 2 shows chassis wall B (212B) as a partial cover for a top of the chassis (204), any removable chassis wall would need to maintain electrically conductive contact with a mating surface of the chassis (204). Thus, if a side, underside, rear, or front wall of the chassis is removably attached, grounding contact would need to similarly be installed in areas of overlap to ensure such electrically conductive contact is maintained. Accordingly, embodiments disclosed herein should not be limited to the configuration of devices and/or components shown in FIG. 2.

Figure 3:
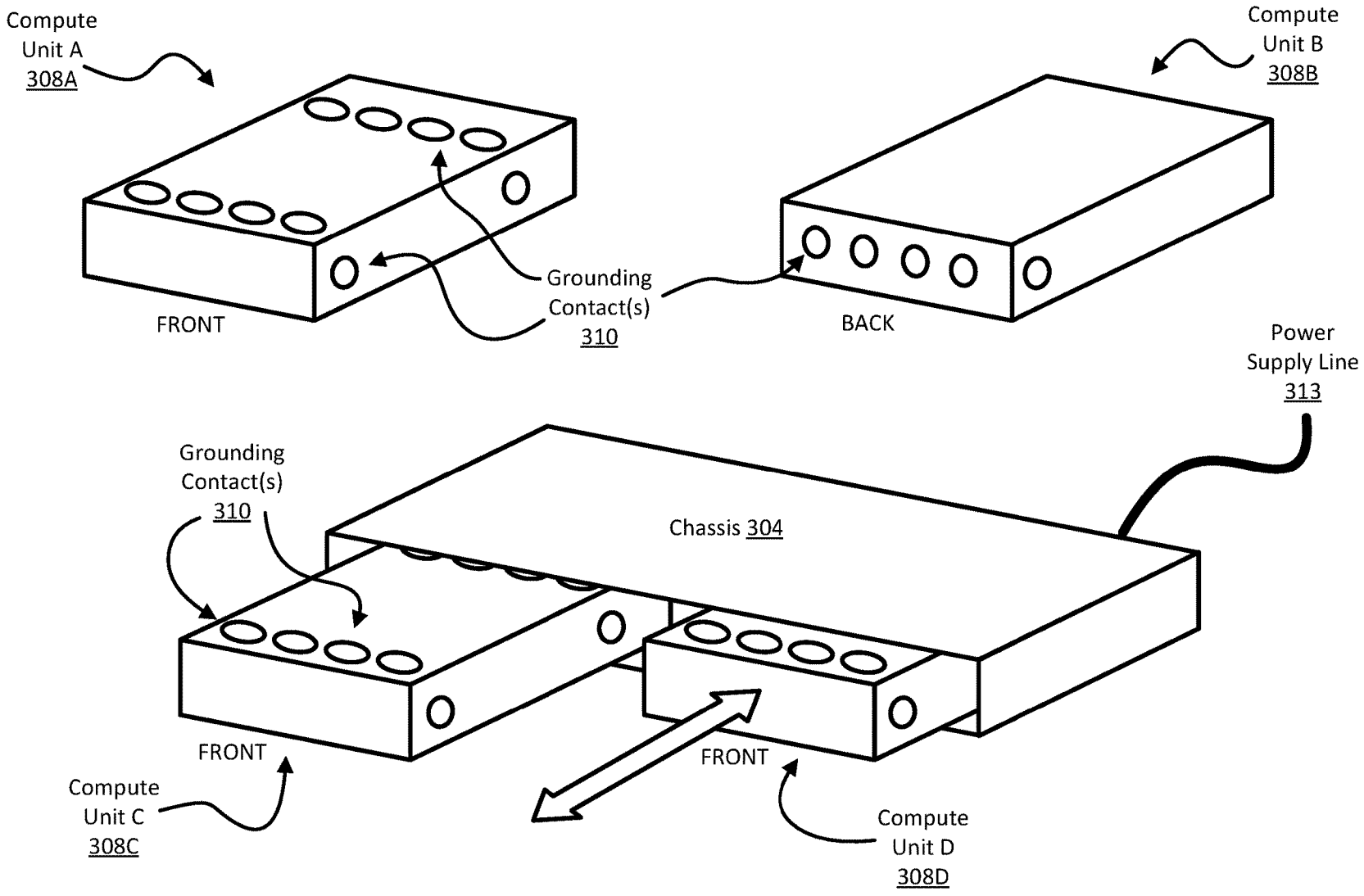
FIG. 3 shows a diagram of a chassis and compute units, in accordance with one or more embodiments of the invention.

FIG. 3 shows a diagram of a chassis and compute units, in accordance with one or more embodiments of the invention. In one or more embodiments of the invention, a chassis (e.g., chassis (304)) is an electrical and/or mechanical device that is adapted to (i) house one or more compute unit(s) (308A-D), (ii) provide electrical operative connection(s) (e.g., peripherals) to one or more compute unit(s) (308A-D) (e.g., for electrical power and/or communications), and/or (iii) provide shared resources to one or more compute unit(s) (308A-D).

In one or more embodiments of the invention, a compute unit (e.g., compute unit A (308A), compute unit B (308B), compute unit C (308C), and compute unit D (308D)) is an electrical and mechanical device adapted to house one or more electrical component(s) (not shown) and may be further adapted to mechanically couple with a chassis (e.g., chassis (304)). Accordingly, in one or more embodiments of the invention, due to the detachable and modular nature of compute units (308A-D), it is desirable to ensure electrically conductive coupling between compute units (308A-D) and the chassis (304) (which is electrically coupled to ground via power supply line (313)).

Accordingly, as shown in FIG. 3, compute unit A (308A) may have grounding contacts (310) disposed on a top surface and a side surface such that, when inserted into the chassis (304), the compute unit A (308A) will maintain electrically conductive coupling with one or more internal surfaces of the chassis (304) in one or more locations. Similarly, for compute unit B (308B), grounding contacts (310) may be disposed on a back side. Thus, when inserted into the chassis (304), compute unit B (308B) will be provided additional surfaces of electrically conductive contact with the chassis (304). In one or more embodiments of the invention, as shown with compute unit C (308C) and compute unit D (308D), the compute units (308C, 308D) may be inserted into the body of the chassis (304) where grounding contacts (310) will bridge the gap between the inner surfaces of the chassis (304) and the external surfaces of the compute units (308C, 308D).

While FIG. 3 shows a specific configuration of a chassis and compute units, other configurations may be used without departing from the scope of the invention. Accordingly, embodiments disclosed herein should not be limited to the configuration of devices and/or components shown in FIG. 3.

Figure 4:
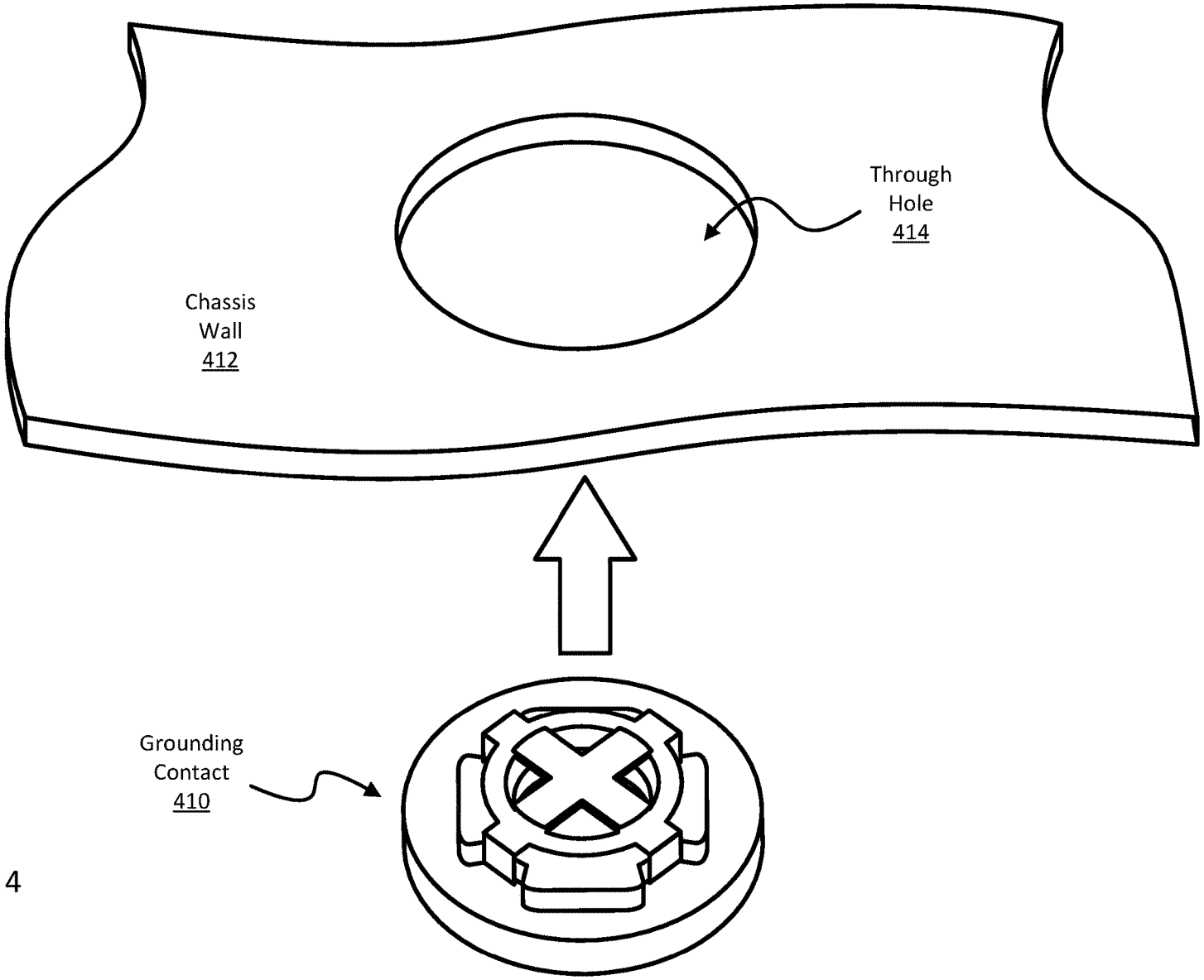
FIG. 4 shows a diagram of a grounding contact and a chassis wall, in accordance with one or more embodiments of the invention.

FIG. 4 shows a diagram of a grounding contact and a chassis wall, in accordance with one or more embodiments of the invention. In one or more embodiments of the invention, a grounding contact (e.g., grounding contact (410)) may be installed in a chassis wall (e.g., chassis wall (412)) during manufacture of the chassis wall (412) or assembly of the chassis components. Further, in one or more embodiments of the invention, a chassis wall (412) may include a through hole (414) that is adapted to fit a grounding contact (410) such that the grounding contact (410) will fill the through hole (414) of the chassis wall (412) and eliminate any gaps created by the through hole (414).

Once installed, the chassis wall (412) and the grounding contact (410) may be further modified to ensure the grounding contact (410) does not become removed from the chassis wall (412) without significant force. As an example, the grounding contact (410) may be welded (not shown) into the chassis wall (412) around the circumference of the through hole (414) thereby reducing the possibility that the grounding contact (410) would become removed from the chassis wall (412). As another example, a rivet (not shown) may be used to maintain mechanical coupling between the grounding contact (410) and chassis wall (412). One of ordinary skill in the art, having the benefit of this detailed description, would appreciate that any suitable form of fastening means may be used to rigidly mechanically couple the grounding contact (410) to the chassis wall (412).

While FIG. 4 shows a specific configuration of a grounding contact and a chassis wall, other configurations may be used without departing from the scope of the invention. Accordingly, embodiments disclosed herein should not be limited to the configuration of devices and/or components shown in FIG. 4.

Figure 5:
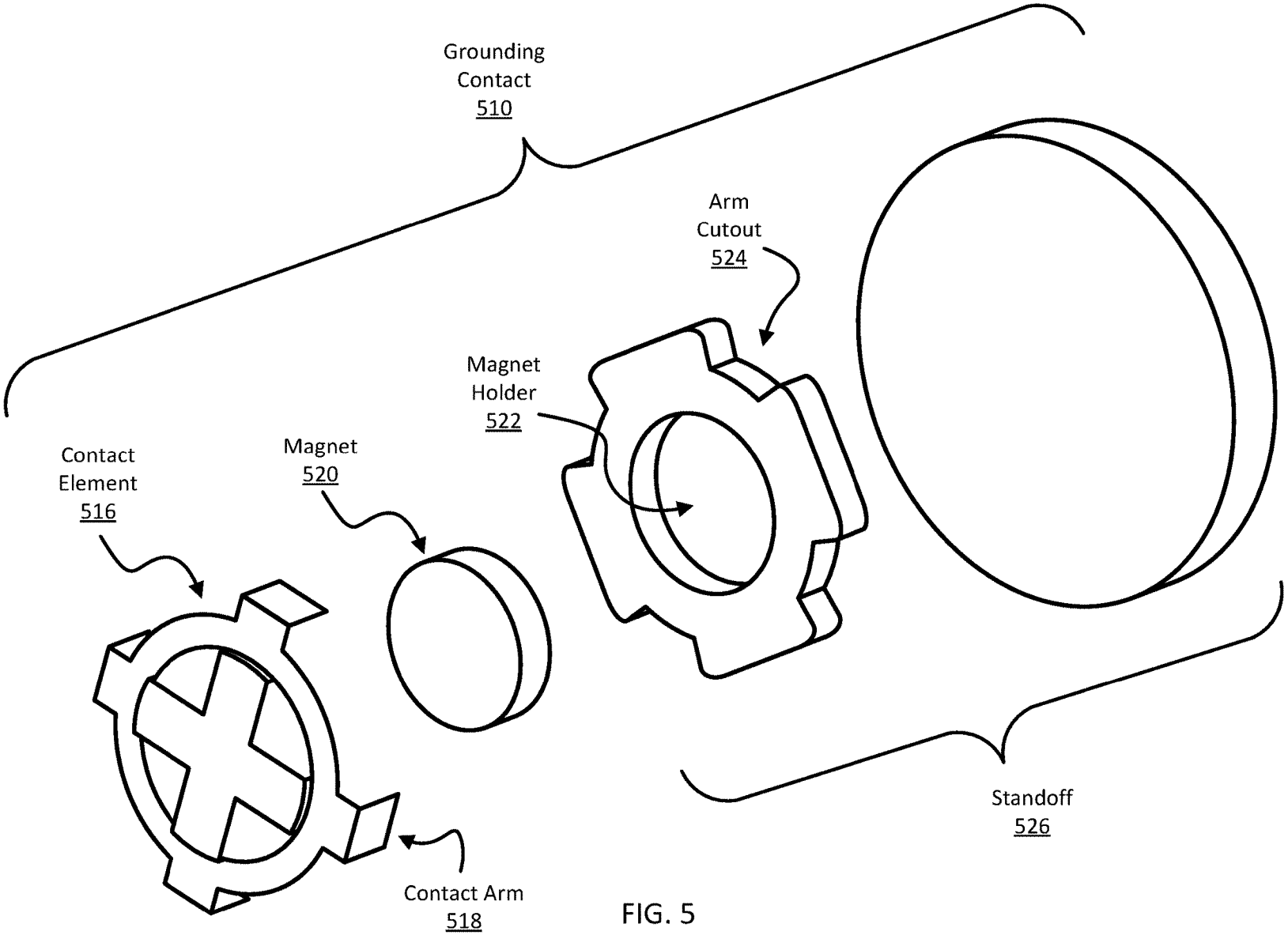
FIG. 5 shows an exploded diagram of a grounding contact, in accordance with one or more embodiments of the invention.

FIG. 5 shows an exploded diagram of a grounding contact, in accordance with one or more embodiments of the invention. A grounding contact (e.g., grounding contact (510)) may include a contact element (e.g., contact element (516)), a contact arm (e.g., contact arm (518)), a magnet (e.g., magnet (520)), and a standoff (e.g., standoff (526)). Each of these components is described below.

In one or more embodiments of the invention, a standoff (e.g., standoff (526)) is a structural component of the grounding contact (510) that provides a surface to be mounted into a chassis wall (not shown) and provide structure for other contact element (516) components to attach to and/or be housed in. Specifically, in one or more embodiments of the invention, a standoff may include a magnet holder (e.g., magnet holder (522)) and an arm cutout (e.g., arm cutout (524)). In one or more embodiments of the invention, the standoff (526) and components thereof may be made from a non-magnetic metal (e.g., aluminum, lead, copper, tin, zinc, gold, silver, etc.) or a magnetic metal that is less magnetic than an opposing metallic surface (e.g., low-carbon steel).

In one or more embodiments of the invention, a contact element (e.g., contact element (516)) is an electrically conductive element of the grounding contact (510), that is configured to contact the surface of another chassis wall (not shown) and/or other opposing metallic surface. Further, in one or more embodiments of the invention, the contact element (516) is mechanically coupled to other components of the grounding contact (510), but the contact element (516) is not rigidly fixed to those components. That is, the contact element (516) may be adapted to translate towards and away from the other components of the grounding contact (510) but cannot be detached entirely due to the tension between one or more contact arm(s) (e.g., contact arm (518)) and one or more arm cutout(s) (e.g., arm cutout (524)). In one or more embodiments of the invention, the contact element (516) may be made from any electrically conductive material (e.g., metals, diamond, etc.).

In one or more embodiments of the invention, a contact arm (e.g., contact arm (518)) is a protruding structure of the contact element (516) that mechanically couples to an arm cutout (524) of the standoff (526). In one or more embodiments of the invention, the contact arm (518) is constructed such that when the contact element is closest to the standoff (526) (e.g., most compacted), there is little or no tension between the arm cutout (524) and the contact arm (518). Further, in one or more embodiments of the invention, when the contact element (516) is extended away from the standoff (526), the contact arm (518) may be constructed such that tension with the arm cutout (524) increases and prevents the contact element (516) from being removed without considerable force or disassembly. The increasing tension may be caused by the arm cutout (524) having a widening diameter towards the contact element (516) and/or the contact arm (518) being bent inwards towards the center of the contact element (516) at its free (not attached) end.

In one or more embodiments of the invention, a magnet (e.g., magnet (520)) is an object that produces a magnet field and causes an attraction (or repelling) force between the magnet and other magnetic objects. In one or more embodiments of the invention, the magnet (520) may be any type of magnet suitable for providing attraction to a metallic surface (e.g., a neodymium magnet, a ferrite magnet). Accordingly, when placed in proximity of a metallic surface (e.g., an opposing chassis wall), the magnet may move towards the metallic surface and force any object disposed in between (e.g., contact element (516)) to contact that metallic surface. In one or more embodiments of the invention, a magnet holder (e.g., magnet holder (522)) is a hollow portion of the standoff (526) that is sufficiently large enough to hold the magnet inside the grounding contact (510). Accordingly, the magnet (520) may be loosely coupled to the grounding contact (510) and may freely translate away from the standoff (526) (with the contact element (516)) to a point where the contact element (516) cannot extend further.

While FIG. 5 shows a specific configuration of a grounding contact, other configurations may be used without departing from the scope of the invention. Accordingly, embodiments disclosed herein should not be limited to the configuration of devices and/or components shown in FIG. 5.

Figure 6:
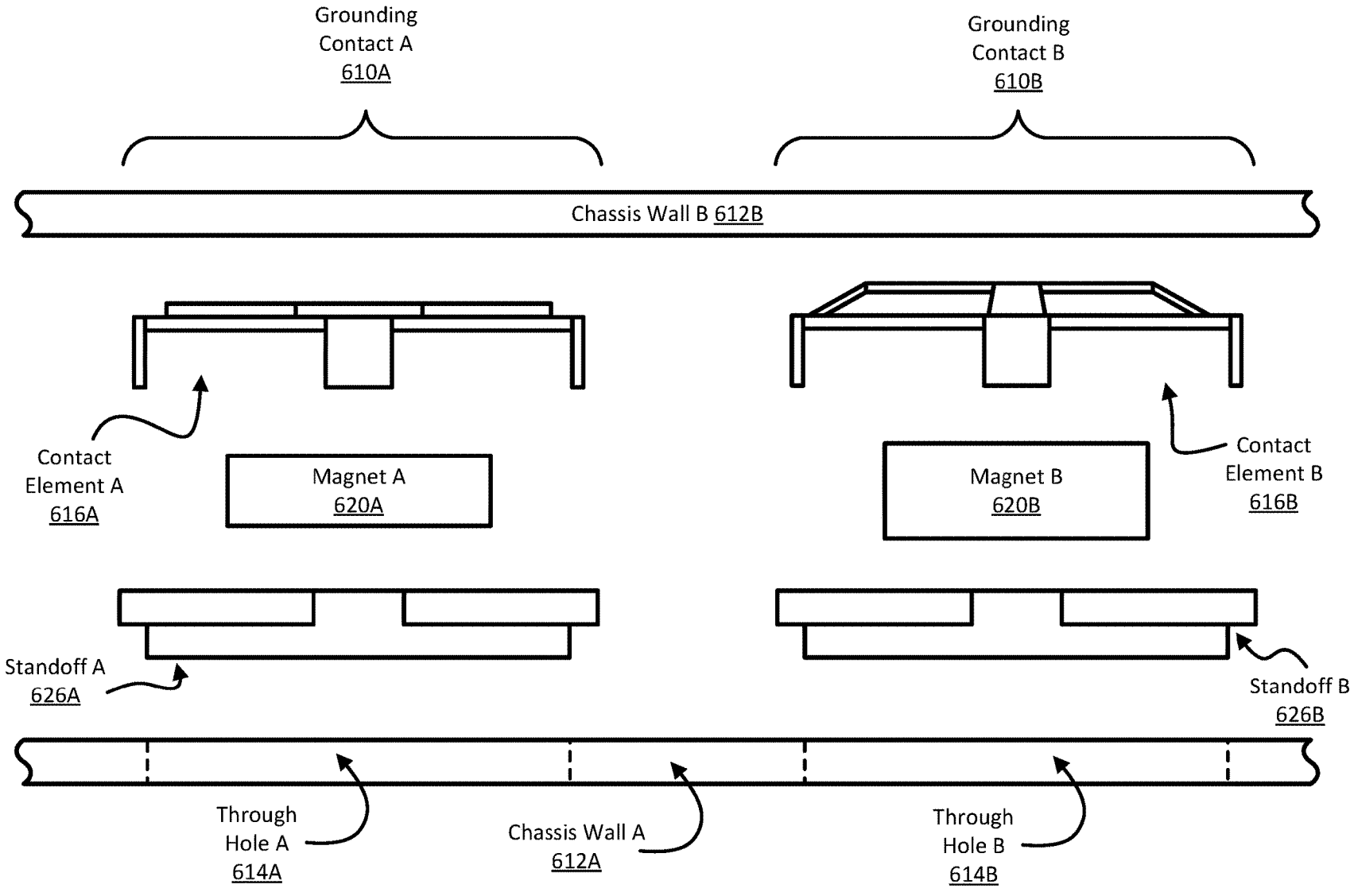
FIG. 6 shows an exploded side view of grounding contacts, in accordance with one or more embodiments of the invention.

FIG. 6 shows an exploded side view of grounding contacts, in accordance with one or more embodiments of the invention. Two embodiments of a grounding contact (e.g., grounding contact A (610A) and grounding contact B (610B)) are shown in FIG. 6. Further, as discussed in the description of FIGS. 3-5, a grounding contact (610A, 610B) may include a standoff (e.g., standoff A (626A), standoff B (626B)), a magnet (e.g., magnet A (620A), magnet B (620B)), and a contact element (e.g., contact element A (616A), contact element B (616B)). Further, the grounding contacts (610A, 610B) may be disposed between two chassis walls (e.g., chassis wall A (612A), chassis wall B (612B), where one of the chassis walls (chassis wall A (612A)) includes one or more through hole(s) (e.g., through hole A (614A), through hole B (614B)) allowing for the insertion and mounting of a standoff (626A, 626B) of each grounding contact (610A, 610B), respectively. Each of these components has the same properties as similarly named components as discussed in the description of FIGS. 3-5.

As shown in FIG. 6, contact elements (616A, 616B) may be sized differently. As an example, contact element A (616A) is shorter (i.e., having less height, thinner) than contact element B (616B). Accordingly, grounding contact B (610B) may be used in chassis and/or compute units where larger gaps between chassis walls (612A, 612B) exist. Further, because contact element B (616B) creates a greater internal volume, a larger magnet (e.g., magnet B (620B)) may be used to allow for a greater magnetic attraction to the more distant metallic surface.

While FIG. 6 shows a specific configuration of grounding contacts, other configurations may be used without departing from the scope of the invention. For example, although only two contact elements (616A, 616B) are shown at two different heights and with two specific geometries, many possible geometries may be constructed to fit the needs of a particular application (including a thinner/shorter or thicker/taller contact element to fill any gap). Accordingly, embodiments disclosed herein should not be limited to the configuration of devices and/or components shown in FIG. 6.

Figure 7A:
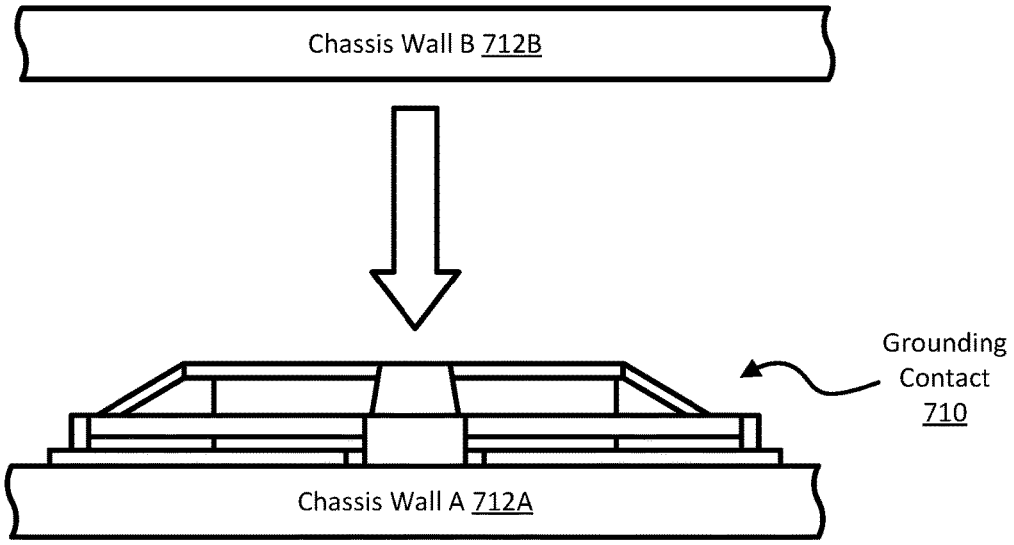
FIG. 7A shows an example of a grounding contact interacting with a chassis wall, in accordance with one or more embodiments of the invention.

FIG. 7A shows an example of a grounding contact interacting with a chassis wall, in accordance with one or more embodiments of the invention. The following use case is for explanatory purposes only and not intended to limit the scope to this embodiment. The example of FIG. 7A includes a grounding contact (710) rigidly mechanically coupled to chassis wall A (712A) with chassis wall B (712B) disposed on the opposite side of the grounding contact (710) from chassis wall A (712A). As discussed in the description of FIGS. 2-3, chassis wall A (712A) may be part of a chassis or part of a compute unit that is (being) installed into a chassis. Similarly, chassis wall B (712B) may be part of the chassis or part of a compute unit.

In FIG. 7A, considering a scenario in which chassis wall B (712B) and grounding contact (710) are moving closer towards each other. In one or more embodiments of the invention, chassis wall B (712B) may be a hinged wall of a chassis that is being closed (e.g., as shown in FIG. 2). Alternatively, chassis wall B (712B) may be a rear wall of an internal bay of a chassis configured to accept a rear side of a compute unit (i.e., chassis wall B (712B) as shown in FIG. 3). In either example, chassis wall B (712B) and grounding contact (710) are moving closer such that grounding contact (710) is likely to make electrically conductive contact with chassis wall B (712B).

Figure 7B:
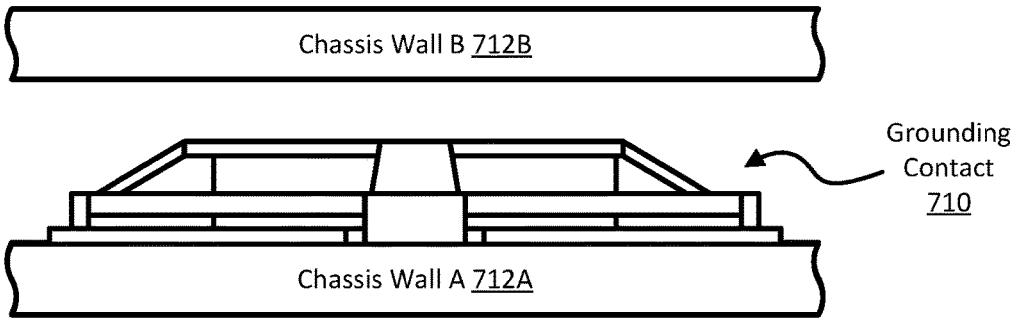
FIG. 7B shows an example of a grounding contact interacting with a chassis wall, in accordance with one or more embodiments of the invention.

FIG. 7B shows an example of a grounding contact interacting with a chassis wall, in accordance with one or more embodiments of the invention. The following use case is for explanatory purposes only and not intended to limit the scope to this embodiment.

Continuing with the example of FIG. 7A, in FIG. 7B, chassis wall A (712A) and chassis wall B (712B) are no longer moving towards each other, and each chassis wall (712A, 712B) is located at their closest distance when assembled. However, as can be seen in FIG. 7B, chassis wall A (712A) and chassis wall B (712B) are electrically conductively isolated (in the region shown) and therefore may carry a voltage difference across their body. Accordingly, for the reasons discussed above, it is desirable to electrically couple chassis wall A (712A) and chassis wall B (712B) such that any voltage difference is carried through the conductive coupling and dissipated through a ground contact of an attached electrical power supply.

Figure 7C:
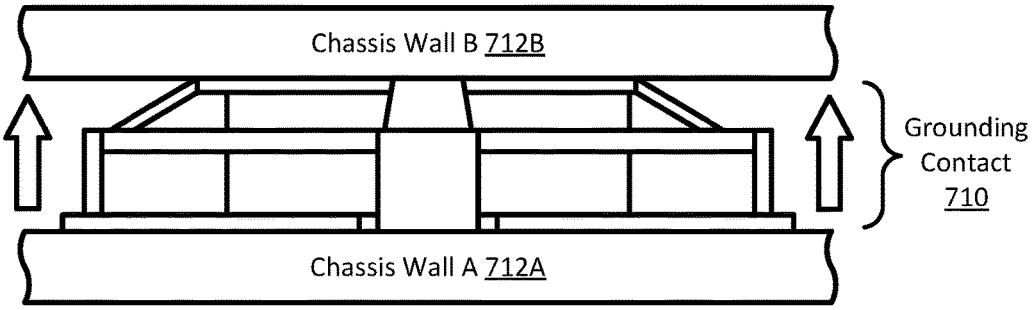
FIG. 7C shows an example of a grounding contact interacting with a chassis wall, in accordance with one or more embodiments of the invention.

FIG. 7C shows an example of a grounding contact interacting with a chassis wall, in accordance with one or more embodiments of the invention. The following use case is for explanatory purposes only and not intended to limit the scope to this embodiment.

Continuing with the example of FIGS. 7A-B, FIG. 7C shows an example where the contact element and magnet of grounding contact (710) move towards—and make electrically conductive contact with—chassis wall B (712B). In one or more embodiments of the invention, the proximity of the magnet of the grounding contact (710) to chassis wall B (712B) causes the magnet to move towards chassis wall B (712B). Consequently, as the contact element of the grounding contact (710) is disposed between the magnet and chassis wall B (712B), the surface of the contact element is forced into contact with the surface of chassis wall B (712B). Further, the contact arms of the contact elements maintain conductive electrical contact with the standoff, thereby providing a complete conductive electrical path between chassis wall B (712B) and chassis wall A (712A) (causing any voltage difference between the two to transfer and neutralize).

Although, in FIGS. 7A-C it is shown that chassis wall A (712A) and chassis wall B (712B) reach their terminal proximity (as shown in FIG. 7B) prior to the contact element moving (as shown in FIG. 7C), one of ordinary skill in the art, having the benefit of this detailed description, would appreciate that the contact element and magnet of the grounding contact (710) will move towards chassis wall B (712B) while chassis wall B (712B) is still in motion towards chassis wall A (712A). The discrete step examples of FIG. 7A-C are shown for explanatory purposes only and should not be used to convey a particular order in which the motion of the components occur.

While one or more embodiments have been described herein with respect to a limited number of embodiments and examples, one of ordinary skill in the art, having the benefit of this detailed description, would appreciate that other embodiments can be devised which do not depart from the scope of the embodiments disclosed herein. Accordingly, the scope should be limited only by the attached claims.

What is claimed is:

1. A grounding contact configured to electrically couple a first chassis wall to a second chassis wall, comprising:

a standoff rigidly coupled to the first chassis wall, the standoff comprising a plurality of arm cutouts and a magnetic holder;

a magnet disposed in the magnetic holder; and a contact element disposed between the magnet and the second chassis wall, the contact element directly contacting the second chassis wall, and the contact element comprising a plurality of contact arms disposed in the plurality of arm cutouts, wherein the plurality of contact arms and the plurality of arm cutouts prevent the contact element from detaching from the grounding contact using tension that increases as the contact element separates from the standoff; and wherein the first chassis wall and the second chassis wall are electrically coupled via the contact element and the standoff.

2. The grounding contact of claim 1, wherein the contact element is not rigidly coupled to the first chassis wall.

3. A method for electrically coupling a first chassis wall and a second chassis wall, comprising:

moving the second chassis wall towards the first chassis wall, the first chassis wall comprising a standoff rigidly coupled thereto, the standoff comprising a plurality of arm cutouts and a magnetic holder;

in response to moving the second chassis wall:

causing a contact element to contact the second chassis wall, the contact element disposed between a magnet and the second chassis wall, the contact element comprising a plurality of contact arms disposed in the plurality of arm cutouts, wherein the plurality of contact arms and the plurality of arm cutouts prevent the contact element from detaching from the grounding contact using tension that increases as the contact element separates from the standoff; and in response to the contact element contacting the second chassis wall:

electrically coupling the first chassis wall and the second chassis wall.

4. The method of claim 3, wherein causing the contact element to contact the second chassis wall comprises:

causing the magnet to move towards the second chassis wall.

5. The method of claim 3, wherein after electrically coupling the first chassis wall and the second chassis wall:

moving the second chassis wall away from the first chassis wall.

6. The method of claim 5, wherein in response to moving the second chassis wall away from the first chassis wall:

causing a magnet to move away from the second chassis wall.

7. The method of claim 5, wherein in response to moving the second chassis wall away from the first chassis wall:

electrically decoupling the first chassis wall and the second chassis wall.

8. The method of claim 5, wherein in response to moving the second chassis wall away from the first chassis wall:

causing the contact element to move towards the first chassis wall.

9. A chassis, comprising:

a first chassis wall;

a second chassis wall; and a grounding contact, comprising:

a standoff rigidly coupled to the first chassis wall, the standoff comprising a plurality of arm cutouts and a magnetic holder;

a magnet disposed in the magnetic holder; and a contact element disposed between the magnet and the second chassis wall, the contact element directly contacting the second chassis wall, and the contact element comprising a plurality of contact arms disposed in the plurality of arm cutouts, wherein the plurality of contact arms and the plurality of arm cutouts prevent the contact element from detaching from the grounding contact using tension that increases as the contact element separates from the standoff; and wherein the first chassis wall and the second chassis wall are electrically coupled via the contact element and the standoff.

10. The chassis of claim 9, wherein the contact element is not rigidly coupled to the first chassis wall.

* * * * *